US011268182B2

(12) United States Patent
Kaltenecker

(10) Patent No.: US 11,268,182 B2
(45) Date of Patent: Mar. 8, 2022

(54) COVERING DEVICE FOR COVERING AT LEAST ONE REGION OF A COMPONENT DURING A HIGH-TEMPERATURE COATING PROCESS

(71) Applicant: MTU Aero Engines AG, Munich (DE)

(72) Inventor: Thomas Kaltenecker, Munich (DE)

(73) Assignee: MTU Aero Engines AG, Munich (DE)

( * ) Notice: Subject to any disclaimer, the term of this patent is extended or adjusted under 35 U.S.C. 154(b) by 37 days.

(21) Appl. No.: 16/440,158

(22) Filed: Jun. 13, 2019

(65) Prior Publication Data

US 2019/0382878 A1 Dec. 19, 2019

(30) Foreign Application Priority Data

Jun. 15, 2018 (DE) ..... 102018209615.5

(51) Int. Cl.

| | |
|---|---|
| ***C23C 4/01*** | (2016.01) |
| ***B05B 12/32*** | (2018.01) |
| ***B05C 21/00*** | (2006.01) |
| *C23C 4/126* | (2016.01) |
| *C23C 4/134* | (2016.01) |
| *C23C 4/129* | (2016.01) |

(52) U.S. Cl.

CPC ..... *C23C 4/01* (2016.01); *B05B 12/32* (2018.02); *B05C 21/005* (2013.01); *C23C 4/126* (2016.01); *C23C 4/129* (2016.01); *C23C 4/134* (2016.01)

(58) Field of Classification Search

None

See application file for complete search history.

(56) References Cited

U.S. PATENT DOCUMENTS 3,276,423 A * 10/1966 Triller ..... H05K 3/143 118/504
4,746,568 A * 5/1988 Matsumoto ..... C09D 183/04 427/270

(Continued)

FOREIGN PATENT DOCUMENTS

DE 3012245 A1 11/1980
DE 3112245 10/1982

(Continued)

OTHER PUBLICATIONS

Structural Heat-Resistant Composites and Fire Barriers, Pyromeral Systems,downloaded from http://www.high-temperature-composites.com/high-temperature-composites-and-fire-barriers-pyrosic-pyrokarb.htm, previously accessed on Apr. 26, 2018, last accessed May 17, 2019.

*Primary Examiner* — Jethro M. Pence

(74) *Attorney, Agent, or Firm* — Davidson, Davidson & Kappel, LLC

(57) ABSTRACT

A covering device (10) for covering at least one region (21) of a component (20) during a high-temperature coating process, the covering device (10) being placed essentially form-fittingly on the component (20) during the high-temperature coating process to prevent the at least one region covered by the covering device from being coated. The elements of the covering device (10) placed essentially form-fittingly on the component (20) are fabricated of a high temperature-resistant plastic which is dimensionally stable during the high-temperature coating process.

20 Claims, 1 Drawing Sheet

(56) References Cited

U.S. PATENT DOCUMENTS

| | | | | |
|---|---|---|---|---|
| 5,631,055 | A * | 5/1997 | Vines | B05B 12/24 428/40.1 |
| 2007/0248806 | A1 | 10/2007 | Kraftician | |
| 2008/0268164 | A1 | 10/2008 | Thayer et al. | |
| 2010/0173092 | A1 | 7/2010 | Wachter et al. | |
| 2011/0177250 | A1 | 7/2011 | Jakimov et al. | |
| 2011/0203521 | A1 | 8/2011 | Ogawa et al. | |
| 2015/0257263 | A1 | 9/2015 | Sethumadhavan et al. | |

FOREIGN PATENT DOCUMENTS

| | | | |
|---|---|---|---|
| DE | 4302276 | C1 | 2/1994 |
| DE | 102008048127 | | 3/2010 |
| DE | 102008053394 | A1 | 4/2010 |
| DE | 102016207863 | A1 | 11/2017 |
| GB | 2049485 | B | 3/1983 |
| WO | WO2004076572 | A1 | 9/2004 |
| WO | WO2014202495 | | 12/2014 |

* cited by examiner

COVERING DEVICE FOR COVERING AT LEAST ONE REGION OF A COMPONENT DURING A HIGH-TEMPERATURE COATING PROCESS

This claims the benefit of German Patent Application DE 102018209615.5, filed Jun. 15, 2018 and hereby incorporated by reference herein.

The present invention relates to a covering device for covering at least one region of a component during a high-temperature coating process, the covering device being placed essentially form-fittingly on the component during the high-temperature coating process to prevent the at least one covered region from being coated.

The present invention can be used in high-temperature coating processes in which at least one region of the component to be coated is covered to exclude it from the coating.

BACKGROUND

Covering devices for covering at least one region of a component during coating processes are generally known. Thus, for example, the German Patent Application DE 10 2016 207 863 A1 describes a masking element made of a silicone-containing material for partially covering a component during thermal coating. Due to the elasticity of the material, such covering devices having silicone-containing masking elements have the advantage of making possible an effective form-fitting engagement on the component and, in response to relative movements between the covering device and the component surface during placement on and removal from the component, there is no risk of the component surface being harmed by scratches or notches, for example. Covering devices, which are fabricated of steel and have a silicone-containing covering element at the sections that come in contact with the components to be coated, for example, also take advantage of this to prevent harm to the component surface. However, such silicone-containing masking elements do not have a high thermal resistance. In particular, they are not suited for a use in coating processes where the component or mask is subject to more than 220° C.

In coating processes where more than 220° C. prevails at the component or mask, covering devices made entirely of steel are usually used. However, the use thereof entails the risk of damage to the surface of the component to be coated. Due to the lack of dimensional stability, such covering devices, which, moreover, also as a function of the component size, can have a relatively high weight and thus be more difficult to handle, are notably not suited for a multiple use in the coating of components using a high-temperature coating process where the temperature at the component or mask is above 220° C., in particular over an extended period of time.

In thermal coating processes, the development continues to ever higher performance coatings, for whose application, high-temperature coating processes are used, where the temperature at the component or mask can be higher than 220° C. and up to 1000° C., in particular over an extended period of time. Such processes are used to coat turbomachine components, for example, which also have regions that are to remain free of the coating. To cover these regions, however, the known covering devices are only suited to a limited extent for high-temperature coating processes, particularly due to the lack of dimensional stability and the risk of damage to the component surface.

It is an object of the present invention to provide an improved covering device that overcomes the disadvantages of the known covering devices.

The present invention provides a covering device for covering at least one region of a component during a high-temperature coating process. The covering device is placed essentially form-fittingly on the component during the high-temperature coating process to prevent the at least one region covered by the covering device from being coated. In the case of the covering device provided here, at least the elements of the covering device that are essentially placed form-fittingly on the component are fabricated from a high temperature-resistant plastic, which features high temperature-resistant fibers and is dimensionally stable at a temperature above 220° C. at the component or mask during the high-temperature coating process.

In particular, the high temperature-resistant plastic is thereby dimensionally stable up to a temperature at the component or mask of 400° C., 500° C., 600° C., 700° C., 800° C., 900° C. or 1000° C.

When coatings are applied to components, covering devices are used for covering those regions which are to remain free of the applied coating. The covering device is placed essentially form-fittingly on the component during application of the coating to prevent coating material from depositing in the covered region of the component surface. In this context, essentially form-fittingly means that the form of the covering device or rather the form of the relevant element of the covering device is essentially that of the covered component surface in the region that borders the region of the component that is not to be coated, so that coating material is not able to reach into the region covered by the covering device and deposit there.

High-temperature coating processes are referred to as those coating processes that produce temperatures of above 220° C. at the component or mask. For the most part, such high-temperature coating processes are thermal spraying processes.

In the context of high-temperature coating processes, the present invention provides that at least the elements of the covering device placed essentially form-fittingly on the component be fabricated of a high temperature-resistant plastic. When working with such a plastic, even temperatures of above 220° C. during the coating process do not lead to damage to the material. In addition, this high temperature-resistant plastic features high temperature-resistant fibers which, especially at higher temperatures, absorb forces caused by internal material stresses or external influences and distribute them in the covering device or in the elements disposed essentially form-fittingly on the component and thus counteract a deformation of the covering device. Thus, as intended, the regions of the components that are not to be coated remain covered during the high-temperature coating process.

The covering device provided may be used at very high temperatures of above 220° C. at the component or mask, without it being distorted at these high temperatures and, therefore, in the case of a multiple use, without the inherent stability of the covering device decreasing to the extent that allows the coating material to deposit in a component region to be covered. Also, by using a plastic material having a lower hardness than a component to be coated, damage to the component surface is avoided upon placement of the covering device on the component and removal thereof therefrom. Moreover, a covering device manufactured of a plastic material is lower in weight than known covering devices made of steel. In addition, the covering device provided is dimensionally stable even in the case of multiple use and is, therefore, reusable. Overall, therefore, the proposed plastic material also makes a simpler design of the device possible because there is no need for braces or the like, for example, to prevent distortion. Thus, a cost-effective design of the covering device is also possible.

As a function of the specific embodiment of the covering device, the high temperature-resistant plastic is dimensionally stable at a temperature of above 400° C., 500° C., 600° C., 700° C., 800° C., 900° C. and/or up to 1000° C. at the component or mask during the high-temperature coating process. The high temperature-resistant plastic used and the fibers contained therein are selected, in particular as a function of the temperatures provided in the high-temperature coating process and the covering device requirements.

In a specific embodiment of the covering device, the high-temperature coating process used is selected from a group that includes flame spraying, plasma spraying, arc spraying, vacuum plasma spraying and detonation spraying.

These thermal spraying processes are surface coating processes. Materials to be added within or outside of a spray burner are thereby melted, surface fused or fused, accelerated in a gas stream in the form of spray particles and centrifuged onto the surface of the component to be coated. The component surface is thereby not surface fused and only minimally thermally loaded. A layer formation takes place since the spray particles, upon impingement on the component surface, flatten to a greater or lesser extent as a function of the process and material, remain adhered primarily due to mechanical interlocking, and build up the coating layer-by-layer. The quality features of such coatings include low porosity, effective binding to the component, freedom from cracks, and a homogeneous microstructure. The layer properties obtained are substantially influenced by the temperature and the velocity of the spray particles at the instance of impingement thereof on the surface to be coated. The energy sources used for surface fusing or fusing the spray material to be added are, in particular an electric arc (arc spraying), a plasma jet (plasma spraying), an oxygen fuel flame or a high-velocity oxygen fuel flame (conventional and high-velocity flame spraying), fast, preheated gases (cold gas spraying) or a laser beam (laser spraying). These processes aim to coat metallic and non-metallic materials with metals, oxide-ceramic materials or carbidic materials (or rather, generally, composite materials) for the purpose of modifying and selectively adapting surface properties.

In a specific embodiment of the covering device, the high temperature-resistant plastic featuring the high temperature-resistant fibers is machinable. Using a machinable plastic makes it possible for a covering device to be manufactured inexpensively, and for modifications and adaptations thereto to be made using typically available tools.

In a specific embodiment of the covering device, the high temperature-resistant plastic featuring the high temperature-resistant fibers is selected from a group that includes composite materials of resin-bonded glass fibers, laminate materials of resin-bonded glass fabric, laminate materials of silicone resin-impregnated mica paper, in particular homogeneously pressed fiber cement materials, mica paper impregnated with heat-resistant binding agents and laminated with a high-temperature nonwoven fabric, for example, and inorganically bonded glass-mica combinations. In the indicated embodiment, the materials mentioned are suited for manufacturing a covering device for covering at least one region of a component during a high-temperature coating process, these materials each featuring a different temperature resistance, and, depending on the application, it being necessary to select a suitable high temperature-resistant plastic material.

A method is also provided for the high-temperature coating of a component where the temperature at the component or mask is above 220° C. during the high-temperature coating, a covering device being used for covering at least one region of the component during the high-temperature coating, the covering device used in the method being designed in accordance with at least one aspect of the covering device described above.

In a specific embodiment of the method provided for high-temperature coating of a component, the temperature during application of the high-temperature coating is above 300° C., 400° C., 500° C., 600° C., 700° C., 800° C., 900° C. and/or, in particular up to 1000° C. The high-temperature coating process used is thereby selected, in particular from a group that includes flame spraying, plasma spraying, arc spraying, vacuum plasma spraying and detonation spraying. Such processes, which are already described in greater detail above, are suited for producing especially heat-resistant coatings on components.

BRIEF DESCRIPTION OF THE DRAWINGS

Other features, advantages and possible applications of the present invention are derived from the following description with reference to the figure. In the drawing, FIG. 1 schematically shows a known covering device for covering a region of a component during a coating process.

DETAILED DESCRIPTION

Figure 1:
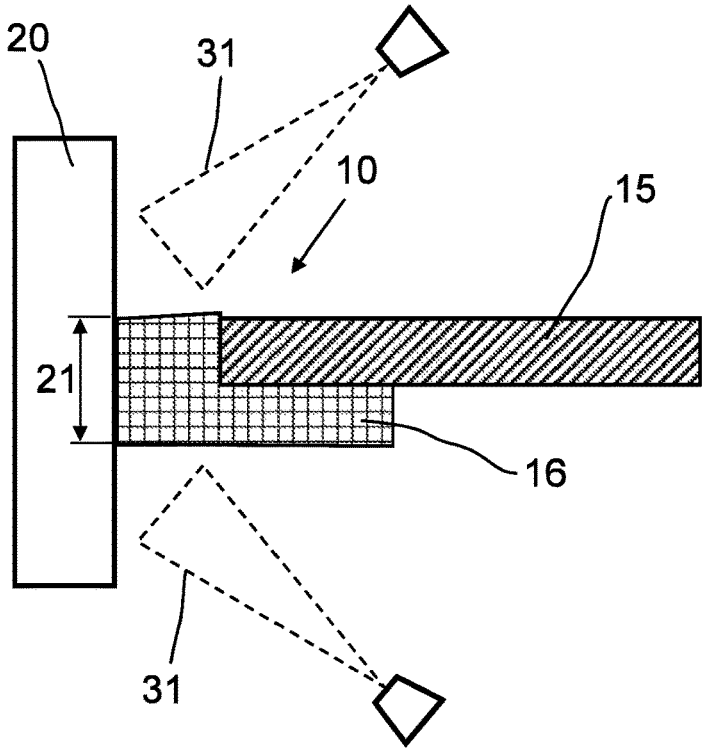

FIG. 1 schematically shows a known covering device 10 for covering a region 21 of a component 20 during a coating process that is implemented at a process temperature of less than 220° C. Covering device 10 thereby has a steel construction 15 which is provided with a silicone element 16. The soft and resilient silicone element 16 fits form-fittingly on component 20. In response to a movement between covering device 10 and component 20, there is no risk of damage to the surface of component 20. During a coating process, which is illustrated in FIG. 1 by two spray cones 31, silicone element 16 of covering device 10 fits form-fittingly on region 21 to be covered and thus prevents region 21 covered by covering device 10 from being coated.

Figure 2:
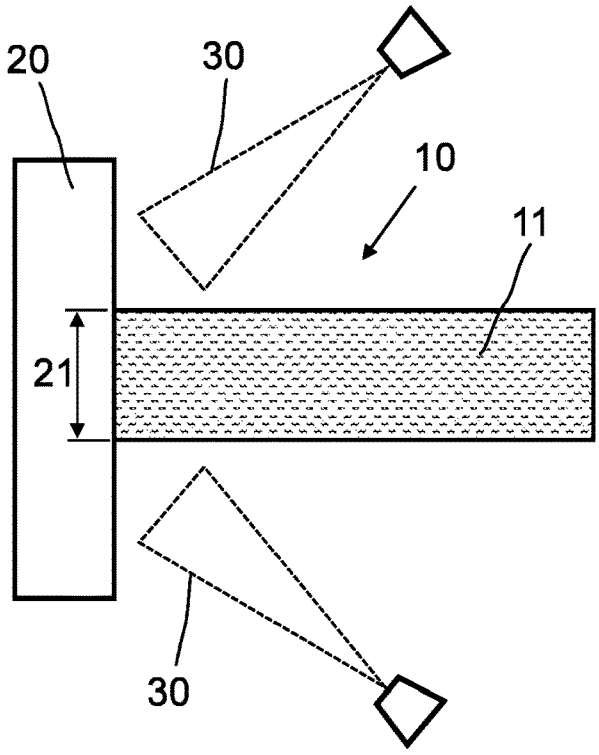
FIG. 2 schematically shows an exemplary specific embodiment of a covering device according to the present invention during a high-temperature coating process.

FIG. 2 schematically shows an exemplary specific embodiment of a covering device 10 according to the present invention during a high-temperature coating process that is implemented at a temperature of above 220° C. at the component or mask. Covering device 10 for covering region 21 of component 20 essentially fits form-fittingly on region 21 of component 20 during the high-temperature coating process to prevent coating of covered region 21. The high-temperature coating process is illustrated in FIG. 2 by two spray cones 30.

Covering device 10, which is essentially placed form-fittingly on component 20, is manufactured from a high temperature-resistant plastic that features high temperature-resistant fibers 11 which counteract the forces occurring during the high-temperature coating process at the high prevailing temperatures and thus a deformation of covering device 10. Thus, the high temperature-resistant plastic is dimensionally stable during the high-temperature coating process at the temperature of above 220° C. and reliably covers region 21.

In this specific embodiment, there is no risk of damage to the surface of component 20 in response to a movement between covering device 10 and component 20 since the high temperature-resistant plastic of covering device 10 has a lower hardness than component 20. Covering device 10 illustrated in FIG. 2 is also lower in weight than covering device 10 of FIG. 1, resulting in a better handling property of covering device 10.

LIST OF REFERENCE NUMERALS

10 covering device
11 high temperature-resistant fibers
15 steel construction
16 silicone element
20 component
21 covered region of the component
30 spray cone (high-temperature coating process)
31 spray cone (coating process)

What is claimed is:

1. A covering device comprising:

a high-temperature-resistant plastic placed form-fittingly on a component, the high-temperature-resistant plastic being selected from the group consisting of laminate materials of resin-bonded glass fabric, laminate materials of silicone resin-impregnated mica paper, homogeneously pressed fiber cement materials, and laminated mica paper impregnated with heat-resistant binding agents, and further including high-temperature-resistant fibers, the high-temperature-resistant plastic being dimensionally stable at a temperature above 220° C. at the component during the high-temperature coating process;

the covering device configured to cover at least one region of the component during a high-temperature coating process, the covering device being placed form-fittingly on the component during the high-temperature coating process to prevent the at least one region covered by the covering device from being coated, and configured so a form of the covering device is that of a covered component surface in a border region bordering a covered region of the component not to be coated, so that coating material is not able to reach into the covered region, and the high-temperature-resistant fibers are configured to absorb forces caused by internal material stresses or external influences and distribute the forces and thus counteract a deformation of the covering device.

2. The covering device as recited in claim 1, wherein the high-temperature-resistant plastic is dimensionally stable at a temperature of above 400° C. at the component or mask during the high-temperature coating process.

3. The covering device as recited in claim 2, wherein the high-temperature-resistant plastic is dimensionally stable at a temperature of above 500° C. at the component or mask during the high-temperature coating process.

4. The covering device as recited in claim 3, wherein the high-temperature-resistant plastic is dimensionally stable at a temperature of above 600° C. at the component or mask during the high-temperature coating process.

5. The covering device as recited in claim 4, wherein the high-temperature-resistant plastic is dimensionally stable at a temperature of above 700° C. at the component or mask during the high-temperature coating process.

6. The covering device as recited in claim 1, wherein the high-temperature-resistant plastic is dimensionally stable at a temperature up to 10000 C at the component or mask during the high-temperature coating process.

7. The covering device as recited in claim 1, wherein the high-temperature coating is selected from the group consisting of flame spraying, plasma spraying, arc spraying, vacuum plasma spraying and detonation spraying.

8. The covering device as recited in claim 1, wherein the high-temperature-resistant plastic is machinable.

9. The covering device as recited in claim 1, wherein the high-temperature-resistant plastic is selected to be solely the laminated mica paper impregnated with heat-resistant binding agents, the laminated mica paper impregnated with heat-resistant binding agents being laminated with a high-temperature nonwoven fabric having the high-temperature-resistant fibers.

10. The covering device as recited in claim 1, wherein the high-temperature-resistant plastic has a lower hardness than the component.

11. A method for high-temperature coating of a component where a temperature is above 220° C. at the component during the high-temperature coating, comprising: covering at least one region of the component during the high-temperature coating with the covering device as recited in claim 1.

12. The method as recited in claim 11, wherein the temperature during application of the high-temperature coating is above 400° C. at the component.

13. The method as recited in claim 12, wherein the temperature during application of the high-temperature coating is above 500° C. at the component.

14. The method as recited in claim 13, wherein the temperature during application of the high-temperature coating is above 600° C. at the component.

15. The method as recited in claim 14, wherein the temperature during application of the high-temperature coating is above 700° C. at the component.

16. The method as recited in claim 11, wherein the temperature during application of the high-temperature coating is less than or equal to 1000° C. at the component.

17. The method as recited in claim 11, wherein the high-temperature coating process used is selected from the group consisting of flame spraying, plasma spraying, arc spraying, vacuum plasma spraying and detonation spraying.

18. A covered component comprising: at least one region covered by the covering device as recited in claim 1.

19. The covered component as recited in claim 18, wherein the high-temperature-resistant plastic has a lower hardness than the component.

20. The covered component as recited in claim 18, further comprising a coating region outside the at least one region.

* * * * *